United States Patent [19]

Reedhead et al.

[11] 4,057,249

[45] Nov. 8, 1977

[54] TENNIS RACKET

[76] Inventors: Frederick W. Reedhead, 66 Birchwood Knoll; Rowland E. Reedhead, 170 Berwyn Place, both of Trenton, N.J. 08638; George W. Reynolds, 52 Cloverdale Circle, New Shrewsbury, N.J. 07724

[21] Appl. No.: 608,492

[22] Filed: Aug. 28, 1975

Related U.S. Application Data

[63] Continuation-in-part of Ser. No. 524,805, Nov. 18, 1974, abandoned.

[51] Int. Cl.[2] ..... A63B 51/12

[52] U.S. Cl. ..... 273/73 E; 273/73 C

[58] Field of Search ..... 273/73 R, 73 C, 73 D, 273/73 E, 73 H

[56] References Cited

U.S. PATENT DOCUMENTS

| | | | |
|---|---|---|---|
| 240,183 | 4/1881 | Richardson | 273/73 E |
| 1,476,906 | 12/1923 | Maria | 273/73 E |
| 2,034,444 | 3/1936 | Rauch et al. | 273/73 E |
| 2,089,118 | 8/1937 | Fritsch | 273/73 E |
| 2,206,548 | 7/1940 | Goerke | 273/73 E |
| 3,528,658 | 9/1970 | Cheris et al. | 273/73 H X |
| 3,834,699 | 9/1974 | Pass | 273/73 D |

FOREIGN PATENT DOCUMENTS

| | | | |
|---|---|---|---|
| 208,945 | 7/1957 | Australia | 273/73 C |
| 252,990 | 7/1964 | Australia | 273/73 D |
| 784,057 | 4/1935 | France | 273/73 E |
| 812,970 | 9/1937 | France | 273/73 E |
| 4,305 | 2/1914 | United Kingdom | 273/73 E |
| 380,915 | 9/1932 | United Kingdom | 273/73 E |
| 5,385 | 3/1889 | United Kingdom | 273/73 E |

*Primary Examiner*—Richard J. Apley
*Attorney, Agent, or Firm*—Albert Sperry; Frederick A. Zoda; John J. Kane

[57] ABSTRACT

A tennis racket or the like is provided with two similar frame elements formed of tubular material and secured together in parallel spaced relation. Sheaves are mounted on the frame elements in the space therebetween and stringing for the racket is passed about the sheaves and arranged so as to permit axial movement of the stringing to equalize or distribute the stress applied thereto during use. The stringing may consist of endless strands of wire, nylon or the like and tensioning means are mounted in the handle of the racket and connected to the stringing to vary and equalize the tension under which the stringing is maintained.

7 Claims, 4 Drawing Figures

TENNIS RACKET

This application is a continuation-in-part of copending application Ser. No. 524,805, filed Nov. 18, 1974, now abandoned.

BACKGROUND OF THE INVENTION

1. Field of the Invention

Tennis rackets and the like are generally provided with a frame formed of wood or metal and are strung with wire, nylon, gut or the like. However, wooden rackets tend to warp or may split or crack under hard usage or neglect whereas metal rackets as heretofore produced do not always have the desired balance or strength and weight distribution between the handle and head portions of the racket.

A further and particular objection to tennis rackets of the prior art is due to the difficulties presented in stringing of the racket and the uneven tension to which the longitudinally and transversally extending strings are subjected during the stringing operation and more especially when the racket is in use.

Attempts have been made heretofore to overcome these objections by variously designing the racket and by the use of rollers and tensioning means mounted in the racket as exemplified by U.S. patents Ser. No. 240,183, U.S. Pat. Nos. 1,476,906, 2,145,785 and 3,724,850 as well as British patent specification No. 4305 of 1914 and British patnet specification No. 390,915 of 1932. However, the constructions thus provided are in general very complicated, expensive and impractical and they do not afford the desired equalization and distribution of tension throughout the stringing of the racket so as to assure controlled driving and rebound of a tennis ball on impact.

2. Summary of the Invention

In accordance with the present invention such objections and difficulties inherent in prior art devices are reduced or overcome and novel constructions are provided which not only assure more uniform and equalized tensioning of the strings of the racket but also provide for better distribution in the weight and balance of the head portion and handle or other parts of the racket.

These advantages are preferably attained by forming the racket with two frame members formed of tubular material of desired cross section and arranged in parallel spaced relation and by locating sheaves in the space between the frame members over which the stringing of the racket is trained. The stringing preferably also embodies an endless strand of wire, nylon, gut or the like and means may be provided for subjecting the stringing to selected and uniform tension.

THE DRAWINGS

Figure 2:
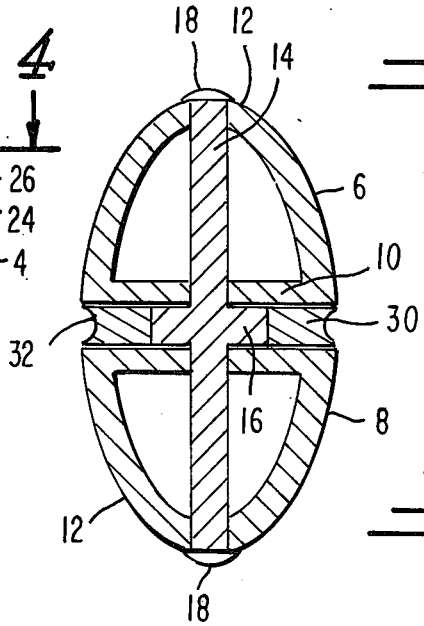
FIG. 2 is an enlarged sectional view of the racket illustrated in FIG. 1 taken on line 2—2 thereof.

In that form of the invention chosen for illustration in the drawings, a tennis racket is provided with a head 2 and a handle 4 which are formed of strong lightweight material such as aluminum, magnesium or alloys thereof and the like. The racket embodies two frame members 6 and 8 which are identical in construction and arranged in spaced parallel relation as shown in FIG. 2. Each frame member is formed of tubing and presents a flat inner face 10 and an outer parabolic surface 12. The frame members are connected together and firmly held in place by spacing pins 14 each provided with a collar 16 engaging the inner flat faces of the tubular members. The outer ends 18 of the pins are welded, peaned over or otherwise secured in place to function as rivets which secure the frame members rigidly in place with respect to each other.

The head 2 of the racket may have any desired or conventional shape while the handle 4 of the racket is formed by the opposite ends of the tubing of which the frame members are formed. Such ends are brought together to form the throat 22 of the racket and extend parallel to each other in the portions 24 to form the handle which is grasped by the player. The portions 24 are held in place by stationary washers 26 or the like and are covered by leather, rubber, or similar wrapping or the like 28.

The flat inner faces 10 of the frame members are spaced apart by the collar 16 and the sheaves 30 are located between the spaced surfaces on the pins 14 and freely rotatable about the collars 16. The sheaves are provided with a peripheral groove 32 for receiving the stringing 34 and have a pitch diameter equal to the desired spacing of the strings in the head of the racket. In this way, the sheaves are fixedly held in position while being freely rotatable about the spacing pins 14 whereby the strings at no point are drawn or bent about their supports at any radius smaller than the pitch diameter of the sheaves. In this way, cutting or mutilation of the strings during stringing of the racket or during use will be precluded.

The sheaves 30 have a pitch diameter equal to the desired spacing of the strings in the racket and the sheaves are spaced apart a similar distance. In this way, the spacing of strings extending across the face of the racket form a sheave on one side of the frame to a sheave on the opposite side of the frame will be uniform or chosen as desired in any particular construction. Since the sheaves 30 are mounted on the spacing pins 14, there will be a suitable number of spacing pins to establish essentially an I-beam assembly of high rigidity for the head of the racket despite the light weight thereof. Moreover, the pins support the sheaves about which the stringing passes so that the forces to which the racket is subjected on striking a ball are distributed to numerous pins throughout the frame members of the racket. Additional spacing pins are provided in the throat and handle to provide a rigid assembly.

In accordance with the present invention, the strings are each axially movable with respect to other strings and with respect to the frame members by reason of their support on the rotatable sheaves 30. Such movement of the strings serves to equalize and distribute the forces to which the stringing is subjected so that all of the strings in the racket are equally stressed and placed under increased tension whenever a ball is struck during play. Moreover, it is possible to use a single endless string having its ends knotted or bonded together whereby the yielding of one length or strand of the string is accompanied by the tightening and movement of another or adjacent length or strand. In this way, the stress is uniformly distributed throughout the racket or connected strands within the stringing and more effective reaction and rebound of the stringing is attained.

Figure 1:
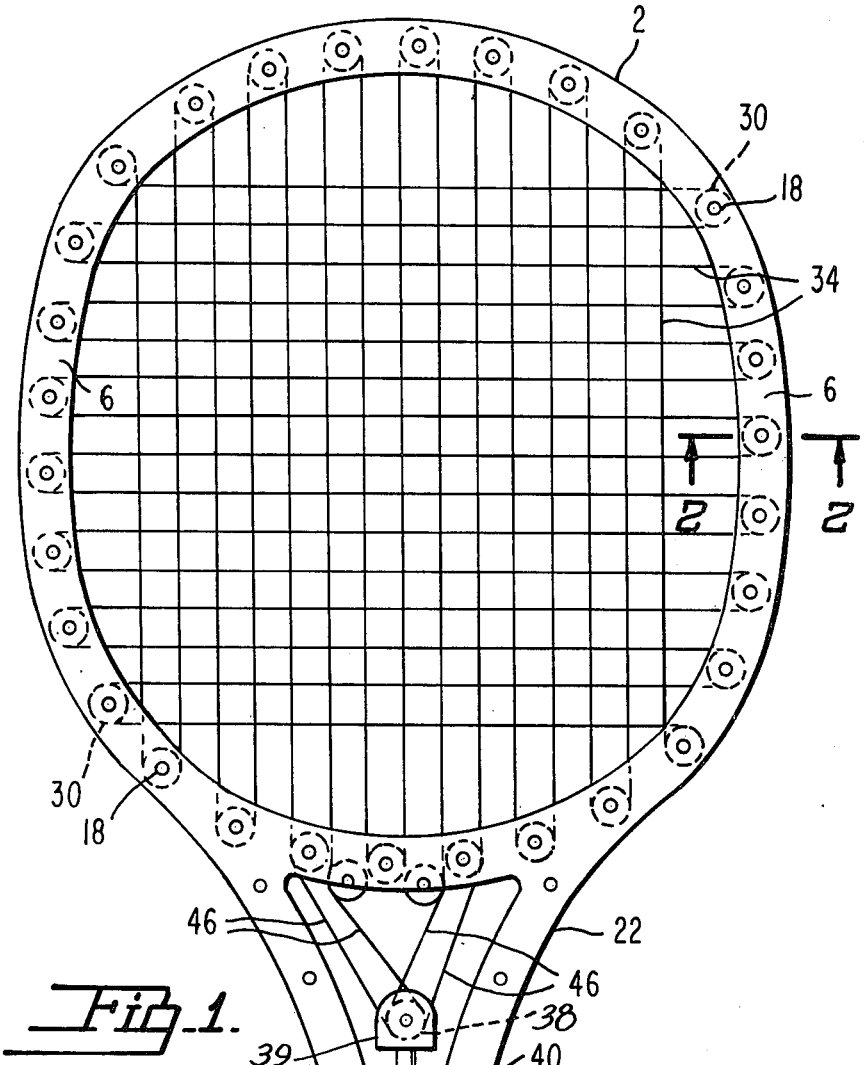
FIG. 1 is a perspective view of a typical form of tennis racket embodying the present invention with parts thereof broken away.
Figure 3:
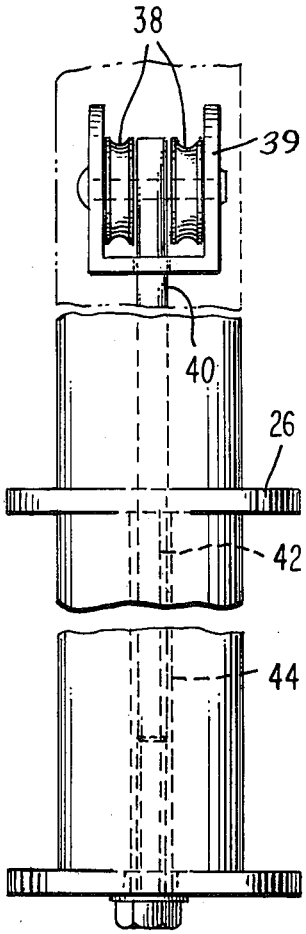
FIG. 3 is a side elevation of an embodiment of the tension adjustment apparatus of the present invention.
Figure 4:
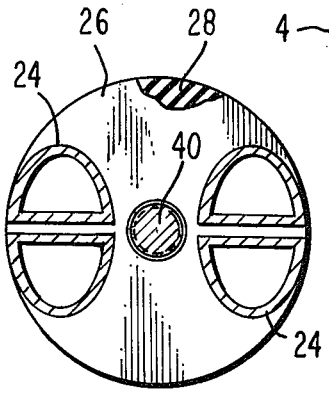
FIG. 4 is a sectional view taken on the line 4—4 of FIG. 1.

In order to control or vary the tension to which the strings of the racket are subjected, adjustable tensioning means may be provided such as that shown in FIG. 3 for example. As there shown tensioning sheaves 38 are mounted rotatably within a yoke 39 and thus secured on a rod 40 which extends parallel to the portions 24 of the frame members forming the handle 4 of the racket. Rod 40 is threaded at 42 and extends into an internally threaded tube 44 mounted for rotation with respect to the stationary washer 26. The tube 44 may be formed with a kerf or socket for receiving a key or screw driver to rotate the tube 44 so as to adjust the position of rod 40 and the position of the tensioning sheaves 38 with respect to the throat 22 and head 2 of the racket.

The tension applied to the stringing of the racket is controlled by passage of the central strands 46 of the stringing about the tensioning roller 38 on rod 40 and by adjusting the position of the roller 38 by rotation of the tube 44. Thus, as the tensioning sheaves 38 move toward the outer end of the handle, the strands 46 are pulled downward drawing all of the strands in the racket tighter to increase the tension thereon. Conversely, the strands may be loosened by rotation of the tube 44 in the opposite direction so that the tension applied to the stringing may be adjusted or varied as required by any individual player.

The manner in which the racket is strung can be selected as desired. Ordinarily, the strands will be woven in and out over each other as they extend longitudinally and transversely of the head of the racket and about the sheave 30. However, if desired the longitudinal strands may be located on one face of the racket and the transverse strands on the other face to provide different action on a ball when it is struck by opposite faces of the racket.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A tennis racket or the like comprising a frame including a head portion, a throat portion and a handle portion, said frame embodying two similar members each formed of hollow material and fixedly arranged in spaced parallel planes;

pins fixedly secured to each said member for holding said members in fixed spaced relation;

sheaves rotatably mounted on said pins and located in the space between said members;

stringing for the head of the racket comprising a single endless string which is unattached to said frame, said single endless string passing only about said sheaves and being freely movable axially to equalize the tension on the stringing axially of the stringing;

tensioning means including rotatable sheave means receiving a part of said stringing which extends into the throat area of the racket, said tensioning means extending lengthwise of the handle and throat portion of said racket; and threaded means rotatably mounted in said handle portion and engaging said tensioning means to adjust the axial tension of said stringing.

2. A tennis racket as defined in claim 1 wherein said hollow frame members include parallel flat surfaces held in spaced relation by said pins.

3. A tennis racket as defined in claim 2 wherein said hollow frame members present opposite and outwardly facing parabolic surfaces.

4. A tennis racket as defined in claim 1 wherein the diameters of said sheaves are equal to spacing distance between said stringing, said stringing having bending radii always at least equal to the pitch diameter of said sheaves.

5. A tennis racket as defined in claim 4 wherein said sheave diameters are at least seven times the diameter of said stringing.

6. A tennis racket as defined in claim 4 wherein all of said sheaves have the same diameter which is equal to the distance between adjacent sections of said stringing to maximize the minimum bending radius of said stringing at any single point.

7. A tennis racket as defined in claim 1 wherein said stringing extends in a direction parallel with respect to said handle portion and in a direction perpendicular with respect to said handle portion.

* * * * *